US005965335A

United States Patent [19]

Oya

[11] Patent Number: 5,965,335

[45] Date of Patent: Oct. 12, 1999

[54] SILVER HALIDE PHOTOGRAPHIC MATERIAL AND METHOD OF FORMING IMAGES IN SAID MATERIAL

[75] Inventor: Toyohisa Oya, Kanagawa, Japan

[73] Assignee: Fuji Photo Film Co., Ltd., Kanagawa, Japan

[21] Appl. No.: 09/067,017

[22] Filed: Apr. 28, 1998

[30] Foreign Application Priority Data

May 8, 1997 [JP] Japan ..... 9-117949

[51] Int. Cl.[6] ..... G03C 5/40

[52] U.S. Cl. ..... 430/394; 430/359; 430/375

[58] Field of Search ..... 430/359, 375, 430/394

[56] References Cited

U.S. PATENT DOCUMENTS 5,667,944 9/1997 Reem et al. ..... 430/359

5,747,228 5/1998 Bohan et al. ..... 430/359

*Primary Examiner*—Hoa Van Le

*Attorney, Agent, or Firm*—Sughrue, Mion, Zinn, Macpeak & Seas, PLLC

[57] ABSTRACT

A method of forming images in a silver halide photographic material having on a support at least one silver halide emulsion layer is described, which comprises a step of irradiating the photographic material with light in the process of image formation after development-processing. A silver halide photographic material comprising at least one compound having formula (I) is also described.

4 Claims, No Drawings

SILVER HALIDE PHOTOGRAPHIC MATERIAL AND METHOD OF FORMING IMAGES IN SAID MATERIAL

FIELD OF THE INVENTION

The present invention relates to a silver halide photographic material which comprises a photochromic compound. More particularly, the present invention concerns a silver halide photographic material which comprises a photochromic compound and undergoes irradiation with light in the process of image formation after development-processing to cause a change in absorption wavelengths of the photochromic compound.

BACKGROUND OF THE INVENTION

Incorporation of spectral sensitizing dyes or photographic dyes into silver halide photographic materials has prevailed in the field of silver halide photographic materials. In some cases, such dyes are observed as undesirable residual color because they still remain in silver halide photographic materials after the photographic materials are finished with image formation. Therefore, it is desirable that spectral sensitizing dyes or photographic dyes be completely removed from silver halide photographic materials or light absorption characteristics in the visible region will be lost after achievement of their purposes. As a means to remove such dyes or make the colors of such dyes disappear, the method of decolorizing a silver halide photographic material through elution of those dyes therefrom during the processing for image formation or the method of inducing the disappearance of colors in those dyes by the chemical reaction with a processing solution has so far been prevailingly employed. In recent years, however, the processing speed for image formation has been increased and the replenishment rates of processing solutions have been lowered; as a result, the means as mentioned above, which rely on the processing solutions used therein, sometimes have failed to completely remove the residual color ascribed to spectral sensitizing dyes or photographic dyes. Thus, measures to solve this problem have been sought.

There are known organic compounds of the kind which undergo reversible changes in their absorption wavelengths when the compound absorbs light of a particular wavelength. In general, these changes caused by light are referred to as photochromic reactions. Examples of an organic compound which is known to undergo a photochromic reaction include pyrenethioindigo, benzylviologen derivatives, benzospiropyran, spiroindolinonaphthoxazine, azobenzene and fulgide. These organic compounds generally exhibit reversible photochromic characteristics, and have a common feature that, even after they have undergone changes in their absorption wavelengths by irradiation with light, the absorption wavelengths thereof revert again to their original ones by exposure to heat or light. In cases where compounds of such a kind are added to silver halide photographic materials for the foregoing purpose, it is desirable that they undergo no or very slow recoloring reaction after the wavelength region in which they absorb light has once been shifted to a region other than the visible region, such as the ultraviolet or infrared region, by irradiation with light. If the irreversible decoloration of spectral sensitizing dyes or photographic dyes is achievable by irradiation with light during the image-forming processing, this irradiation means is very useful from the viewpoints of an increase in processing speed and a reduction in replenishment rate.

As examples of an organic compound which can undergo decoloration by applying thereto an energy such as heat, the cyanine dyes having alkoxy groups substituted on their nitrogen atoms have been proposed in, e.g., U.S. Pat. No. 3,745,009. However, those compounds have problems of stability and easiness in production, and the fact is that organic compounds having properties suitable for spectral sensitizing dyes or photographic dyes incorporated in silver halide photographic materials have not been obtained yet. Under these circumstances, it is strongly desired to find organic compounds which are stable upon storage, can rapidly cause irreversible decoloration or irreversible change in wavelengths at which they show absorption maxima by the absorption of light at particular wavelengths and, what is more, can be produced with ease, and silver halide photographic materials comprising those compounds as well.

SUMMARY OF THE INVENTION

An object of the present invention is therefore to provide a silver halide photographic material which comprises a methine compound having the properties of undergoing irreversible decoloration upon absorption of light at particular wavelengths to be materially reduced in residual color after processing, and a method of forming images in the aforesaid photographic material.

As a result of the inventor's intensive studies, it has been found that the object of the present invention can be attained by an image formation method using a silver halide photographic material described below.

More specifically, the present invention is:

(1) a method of forming images in a silver halide photographic material having on a support at least one silver halide emulsion layer, which comprises a step of irradiating the photographic material with light in the process of image formation after development-processing;

(2) the image formation method according to the aforesaid method (1), wherein the photographic material comprises at least one compound represented by the following formula (I):

(I)

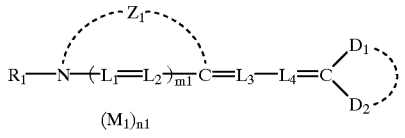

wherein $Z_1$ represents atomic groups forming a 5- or 6-membered nitrogen-containing heterocyclic ring, $D_1$ and $D_2$ are atomic groups forming an acyclic or cyclic acid nucleus, $R_1$ represents an alkyl group, $L_1$, $L_2$, $L_3$ and $L_4$ are each a methine group, $m_1$ is 0 or 1, $M_1$ represents a counter ion, and $n_1$ represents the number of counter ions required for neutralization of charges on one molecule;

(3) the image formation method according to the method (2), wherein the compound represented by formula (I) is a compound selected from the compounds having the following formula (II):

(II)

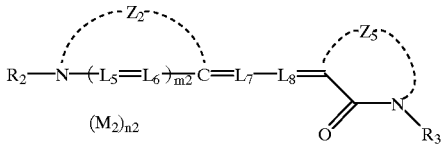

wherein $Z_2$ and $Z_5$ each represents atomic groups forming a 5- or 6-membered nitrogen-containing heterocyclic ring, $R_2$ represents an alkyl group, $R_3$ represents a hydrogen atom, an alkyl group, an aryl group or a heterocyclic group, $L_5$, $L_6$, $L_7$ and $L_8$ are each a methine group, $m_2$ is 0 or 1, $M_2$ represents a counter ion, and $n_2$ represents the number of counter ions required for neutralization of charges on one molecule;

(4) the image formation method according to the method (2), wherein the compound represented by formula (I) is a compound selected from the compounds having the following formula (III) or (IV):

(III)

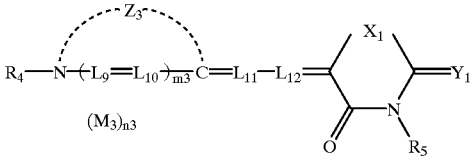

wherein $Z_3$ represents atomic groups forming a 5- or 6-membered nitrogen-containing heterocyclic ring, $R_4$ represents an alkyl group, $R_5$ represents a hydrogen atom, an alkyl group, an aryl group or a heterocyclic group, $L_9$, $L_{10}$, $L_{11}$, and $L_{12}$ are each a methine group, $X_1$ represents an oxygen atom, a sulfur atom or a group of formula —N($R_{10}$)—, $R_{10}$ represents a hydrogen atom, an alkyl group, an aryl group or a heterocyclic group, $Y_1$ represents an oxygen atom or a sulfur atom, $m_3$ is 0 or 1, $M_3$ reprsents a counter ion, and $n_3$ represents the number of counter ions required for neutralization of charges on one molecule, (IV)

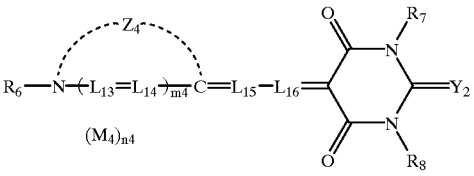

wherein $Z_4$ represents atomic groups forming a 5- or 6-membered nitrogen-containing heterocyclic ring, $R_6$ represents an alkyl group, $R_7$ and $R_8$ each represents a hydrogen atom, an alkyl group, an aryl group or a heterocyclic group, $L_{13}$, $L_{14}$, $L_{15}$ and $L_{16}$ are each a methine group, $Y_2$ represents an oxygen atom or a sulfur atom, $m_4$ is 0 or 1, $M_4$ represents a counter ion, and $n_4$ represents the number of counter ions required for neutralization of charges on one molecule;

(5) a silver halide photographic material comprising at least one compound having the formula (I) described in the foregoing method (2);

(6) a silver halide photographic material comprising at least one compound having the formula (II) described in the foregoing method (3); or (7) a silver halide photographic material comprising a compound selected from the compounds having the formula (III) or (IV) described in the foregoing method (4).

DETAILED DESCRIPTION OF THE INVENTION

The compounds according to the present invention which are represented by the foregoing formula (I), including those having the foregoing formulae (II), (III) and (IV) respectively, are illustrated below in detail.

Examples of a nitrogen-containing heterocyclic ring formed by $Z_1$, $Z_2$, $Z_3$ and $Z_4$ each include oxazole, benzoxazole, naphtho[1,2-d]oxazole, naphtho[2,1-d] oxazole, naphtho [2,3-d]oxazole, oxazoline, thiazole, benzothiazole, naphtho[1,2-d]thiazole, naphtho[2,1-d] thiazole, naphtho[2,3-d]thiazole, thiazoline, selenazole, selenazoline, benzoselenazole, tellurazole, benzotellurazole, quinoline, benzoimidazole, imidazole, indoline, oxadiazole and imidazo[4,5-b]qionoxaline nuclei. Benzothiazole, benzoxazole, benzoimidazole, oxazole, oxazoline, thiazole, thiazoline and quinone nuclei are preferred. In particular, oxazoline, thiazoline, oxazole and benzoxazole nuclei are preferred over the other nuclei.

These nitrogen-containing heterocyclic rings each may have no or a certain substituent group. Examples of such a substituent group include a halogen atom (e.g., fluorine, chlorine, bromine, iodine), a cyano group, an alkoxy group (e.g., methoxy, ethoxy, methoxyethoxy), an aryloxy group (e.g., phenoxy), an alkyl group (e.g., methyl, ethyl, cyclopropyl, cyclohexyl, trifluoromethyl, methoxyethyl, allyl, benzyl), an alkylthio group (e.g., methylthio, ethylthio), an alkenyl group (e.g., vinyl, 1-propenyl), an aryl group (e.g., phenyl, tolyl, p-chlorophenyl, m-methoxyphenyl), and a heterocyclic group (e.g., thienyl, furyl, pyridyl, pyrrolyl).

$R_1$, $R_2$, $R_4$ and $R_6$ each represents an alkyl group containing 1 to 10, preferably 1 to 6, carbon atoms, which may have a substituent group. Examples of such a substituent group include a group capable of producing an anion by releasing a proton, such as a sulfo group, a carboxyl group or an imido group having a formula —CO—NH—$SO_2$—, —CO—NH—CO— or the like, a halogen atom (e.g., fluorine, chlorine, bromine, iodine), a hydroxyl group, an alkoxy group (e.g., methoxy, ethoxy, propoxy), a hydroxyalkoxy group (e.g., 2-hydroxyethoxy), and a complex substituent such as —CO—O—(alkyl)—COOH or —CO—O—(alkyl)—OH.

Of those alkyl groups, ethyl, methyl, 2-sulfoethyl, 3-sulfopropyl, 3-sulfobutyl, 4-syulfobutyl, 3-methyl-4-sulfobutyl and —$CH_2CONHSO_2CH_3$ groups are favorable over the other groups, and further favorable ones are 2-sulfoethyl, 3-sulfopropyl, 3-sulfobutyl, 4-sulfobutyl and 3-methyl-4-sulfobutyl groups. In particular, 2-sulfoethyl, 3-sulfopropyl and 4-sulfobutyl groups are preferred over the others.

The substituent group represented by $R_3$, $R_5$, $R_7$, $R_8$ and $R_{10}$ each is a hydrogen atom, an alkyl group containing 1 to 18, preferably 1 to 7, particularly preferably 1 to 4, carbon atoms (e.g., methyl, ethyl, propyl, isopropyl, butyl, isobutyl), an aryl group containing 6 to 18 carbon atoms (e.g., phenyl, 2-naphthyl, 1-naphthyl), or a heterocyclic group containing 1 to 18 carbon atoms (e.g., 2-thiazolyl, 2-furyl, 5-pyrazolyl, 2-pyrazolyl, 2-pyridyl, 2-pyrazinyl, 2-pyrimidyl). The groups recited above may further have a substituent group. Examples of such a substituent group include a carboxyl group, a sulfo group, a cyano group, a nitro group, a hydrogen atom (e.g., fluorine, chlorine, bromine, iodine), a hydroxyl group, an alkoxy group containing 1 to 8 carbon atoms (e.g., methoxy, ethoxy, benzyloxy, phenetyloxy), an acyloxy group containing 2 to 8 carbon atoms (e.g., acetyloxy), an alkoxycarbonyl group containing 2 to 8 carbon atoms, an acyl group containing 2 to 8 carbon atoms, a sulfamoyl group, a carbamoyl group, an alkanesulfonylaminocarbonyl group containing 2 to 8 carbon atoms (e.g., methanesulfonylaminocarbonyl), an acylaminosulfonyl group containing 2 to 8 carbon atoms (e.g., acetylaminosulfonyl), an aryl group containing 6 to 15 carbon atoms (e.g., phenyl, 4-methylphenyl, 4-chlorophenyl, naphthyl) and a heterocyclic group containing 1 to 15 carbon atoms (e.g., pyrrolidine-2-one-1-yl, tetrahydrofurfuryl, 2-morpholino), which each may further be substituted with any of those groups.

$D_1$ and $D_2$ are atomic groups forming an acyclic or cyclic acidic nucleus, and the acidic nucleus formed thereby can be any of the acidic nuclei of general merocyanine dyes. The term acidic nuclei used herein is intended to include those defined in, e.g., *The Theory of The Photographic Process*, page 198, 4th edition edited by T. H. James, published in 1977 by Macmillan Publishing Co., Inc.

In cases where $D_1$ and $D_2$ form an acyclic acidic nucleus, the terminal of a methine link is a malononitrile group, an alkanesulfonylacetonitrile group, a cyanomethylbenzofranylketone group, a cyanomethylphenylketone group or the like.

In cases where $D_1$ and $D_2$ form a cyclic acidic nucleus, the cyclic acidic nucleus formed is a 5- or 6-membered heterocycle which is constituted of carbon, nitrogen and chalcogen atoms (typically, oxygen, sulfur, selenium and tellurium).

Suitable examples of such a heterocycle include 2-pyrazoline-5-one, pyrazolidine-3,5-dione, imidazoline-5-one, hydantoin, 2- or 4-thiohydantoin, 2-iminooxazolidine-4-one, 2-oxazoline-5-one, 2-thiooxazolidine-2,4-dione, isooxazoline-5-one, 2-thiazoline-4-one, thiazolidine-4-one, thiazolidone-2,4-dione, rhodanine, thiazolidine-2,4-dithione, isorhodanine, indane-1,3-dione, thiophene-3-one, thiophene-3-one-1,1-dioxide, indoline-2-one, indoline-3-one, indazoline-3-one, 2-oxoindazolinium, 3-oxoindazolinium, 5,7-dioxo-6,7-dihydrothiazo [3,2-a] pyrimidine, cyclohexane-1,3-dione, 3,4-dihydroisoquinoline-4-one, 1,3-dioxane-4,4-dione, barbituric acid, 2-thiobarbituric acid, chroman-2,4-dione, indazoline-2-one, pyrido [1,2-a]-pyrimidine-1,3-dione, pyrazolo[1,5-b]quinazolone, pyrazolo [1,5-b] benzimidazole, 1,2,3,4-tetrahydroquinoline-2,4-dione, 3-oxo-2,3-dihydrobenzo[d]thiophene-1,1-dioxide and 3-dicyanomethine-2,3-dihydrobenzo[d]thiophene-1,1-dioxide.

Preferably, the heterocycles as the acidic nuclei are rhodanine, oxazolidine-2-thione-4-one, 2-thiohydantoin and 2-thiobarbituric acid. In particular, oxazolidine-2-thione-4-one and 2-thiobarbituric acid are favorable over the others.

The nitrogen-containing heterocycles as described above may have on their nitrogen atoms the same substituent groups as $R_3$, $R_5$ and $R_8$ represent.

$L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$ and $L_{16}$ are each a methine group which may have a substituent. Examples of such a substituent include an alkyl group (preferably containing 1 to 12 carbon atoms, and more preferably containing 1 to 7 carbon atoms, such as methyl, ethyl, propyl, isopropyl, cyclopropyl, butyl, 2-carboxyethyl or benzyl), a substituted or unsubstituted aryl group (preferably containing 6 to 10 carbon atoms, and more preferably containing 6 to 8 carbon atoms, such as phenyl, toluyl, chlorphenyl or o-carboxyphenyl), a heterocyclic group (e.g., pyridyl, thienyl, furanyl, barbituric acid), a halogen atom (e.g., chlorine, bromine), an alkoxy group (e.g., methoxy, ethoxy) and an amino group (preferably containing 1 to 12 carbon atoms, and more preferably containing 6 to 12 carbon atoms, such as diphenylamino, methylphenylamino or 4-acetylpiperazine-1-yl). In particular, it is desirable that each of those methine groups be unsubstituted or substituted with a methyl or ethyl group. Also, such substituents on methine groups can form rings by combining with auxochromes.

$M_1$, $M_2$, $M_3$ and $M_4$ are contained in the formulae (I), (II), (III) and (IV) respectively to show the presence or absence of a cation or anion in case each compound requires a counter ion for intramolecular neutralization of ionic charge. Whether a compound according to the present invention has a cation, an anion or no net ionic charge depends on its molecular structure and substituent groups.

Examples of a typical cation as a counter ion include inorganic and organic ammonium ions (e.g., triethylammonium ion, pyridinium ion), alkali metal ions (e.g., sodium ion, potassium ion) and alkaline earth metal ions (e.g., calcium ion, magnesium ion).

Examples of a typical anion as a counter ion include halide ions (e.g., fluoride ion, chloride ion, bromide ion, iodide ion), arylsulfonic acid ions (e.g., p-toluenesulfonic acid ion, p-chlorobenzenesulfonic acid ion), alkylsulfonic acid ions (e.g., methanesulfonic acid ion), aryldisulfonic acid ions (e.g., 1,3-benzenedisulfonic acid ion, 1,5-naphthalenedisulfonic acid ion, 2,6-naphthalenedisulfonic acid ion), alkylsulfate ions (e.g., methylsulfate ion, ethylsulfate ion), sulfuric acid ion, thiocyanic acid ion, perchloric acid ion, tetrafluoroboric acid ion, pyrophosphoric acid ion, acetic acid ion, trifluoromethanesulfonic acid ion and hexafluorophosphoric acid ion. Further, the counter ion can be an ionic polymer, another organic compound having the opposite charge, or a metal complex ion (e.g., bis(1,2-benzenedithiorato)nickelate(III) ion).

Of those ions, sodium ion, potassium ion, triethylammonium ion and pyridinium ion are preferred over the others. In particular, sodium ion, potassium ion and triethylammonium ion are advantageous.

$n_1$, $n_2$, $n_3$ and $n_4$ are each the number of a counter ion required for neutralizing ionic charge, which is preferably 1 although it may be 0 or more.

Examples of a compound represented by formula (I) are illustrated below, but it should be understood that these examples are not to be construed as limiting the scope of the present invention in any way.

(I-1)

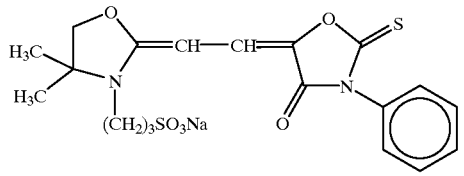

(I-2)

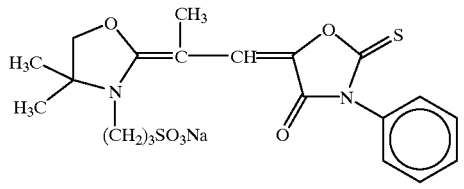

-continued
(I-3)
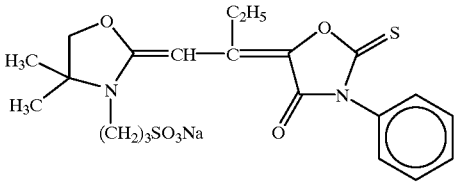
(I-4)
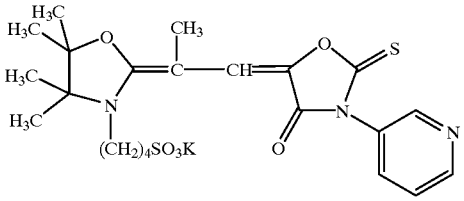
(I-5)
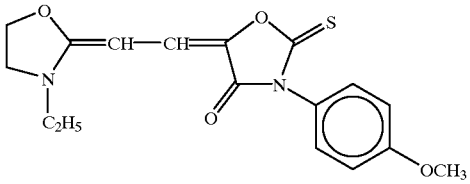
(I-6)
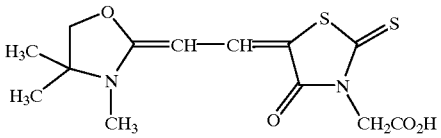
(I-7)
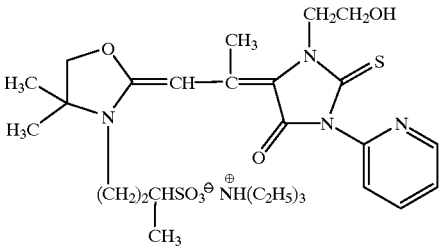
(I-8)
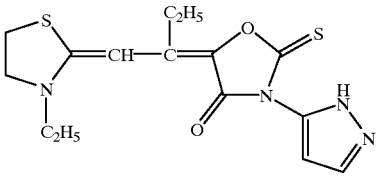
(I-9)
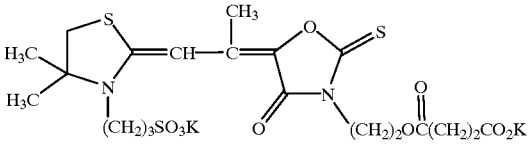
-continued
(I-10)
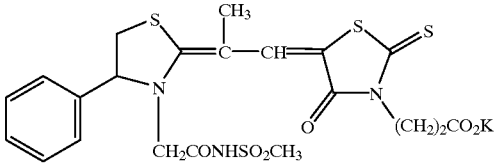
(I-11)
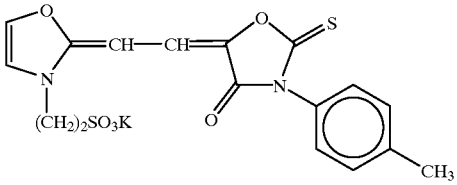
(I-12)
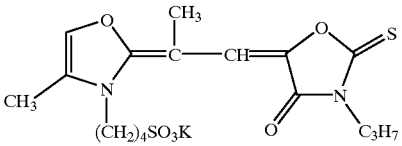
(I-13)
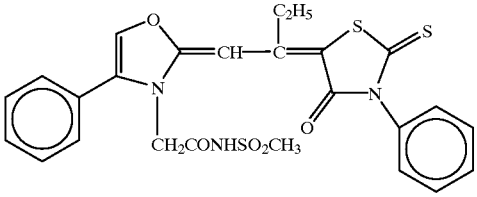
(I-14)
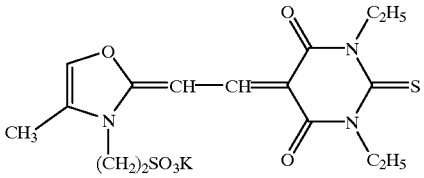
(I-15)
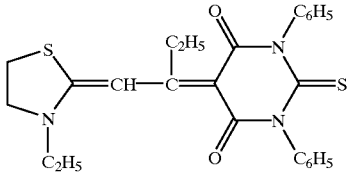
(I-16)
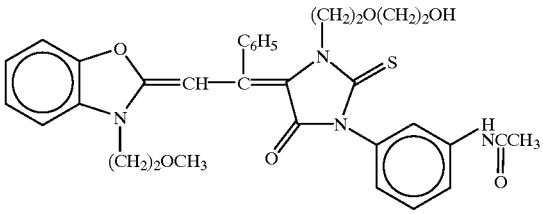
(I-17)
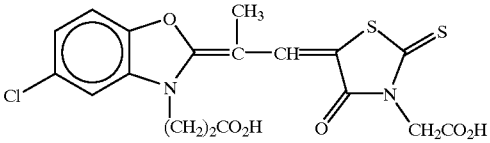

-continued (I-18)

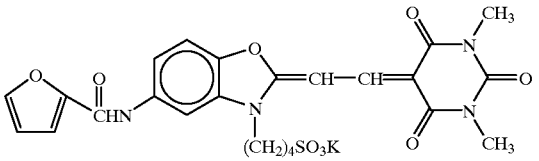

(I-19)

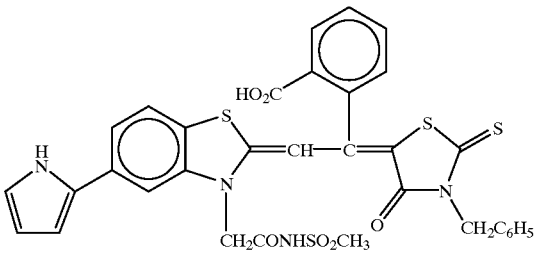

(I-20)

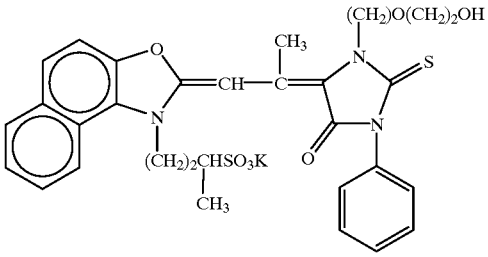

(I-21)

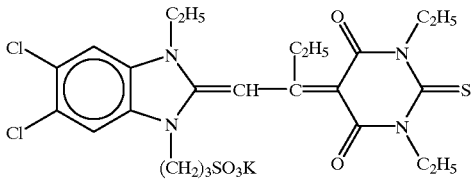

(I-22)

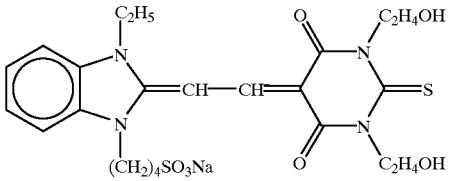

(I-23)

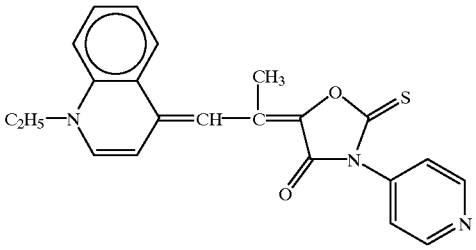

(I-24)

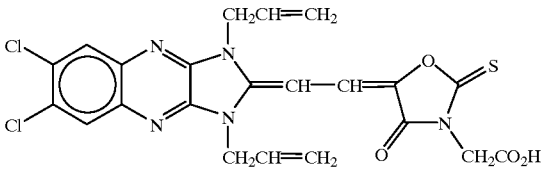

-continued (I-24)

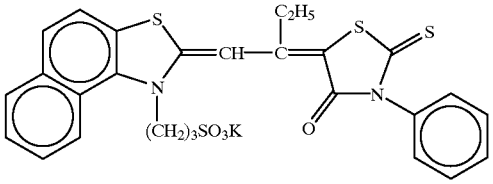

(I-26)

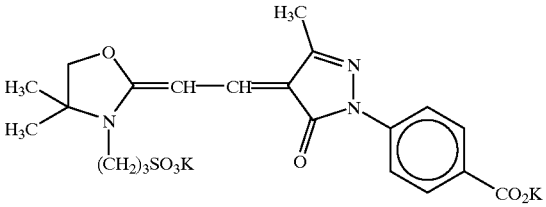

(I-27)

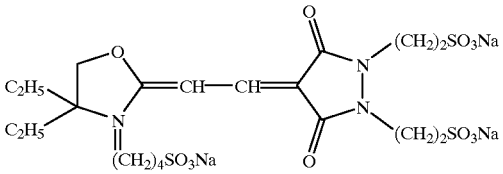

(I-28)

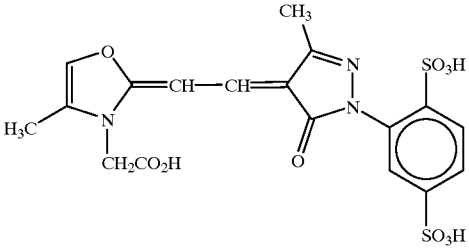

(I-29)

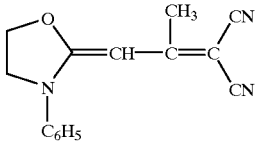

(I-30)

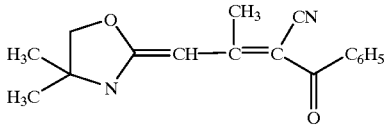

The methine compounds which are represented by formula (I) according to the present invention can be synthesized with ease by reference to the synthesis examples described in the following literatures and the references quoted therein:

(a) *Dokl. Akad. Nauk SSSR*, vol. 177, p. 869 (1967);

(b) F. M. Harmer, *Heterocyclic Compounds -Cyanine Dyes and Related Compounds-*, John Weley & Sons, New York•London (1964);

(c) D. M. Starmer, *Heterocyclic Compounds -Special Topics in Heterocyclic Chemistry*, John Weley & Sons, New York•London (1977); and (d) JP-B-47-4085, JP-B-46-549 (The term "JP-B" as used herein means an "examined Japanese patent publication"), U.S. Pat. No. 3,625,698 and U.S. Pat. No. 3,567,458.

Syntheses of the methine compounds according to the present invention will now be illustrated by the following examples. However, these examples should not be construed as determinative of the synthesis methods applicable to the methine compounds according to the present invention. According to the synthesis methods illustrated below, the other dyes having formula (I) can be synthesized with ease by persons skilled in the art.

Intermediate II-1

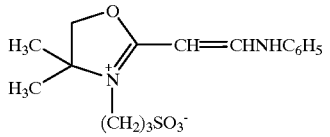

Intermediate II-2

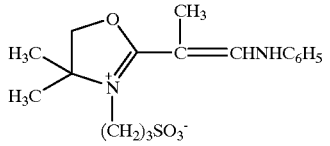

Intermediate II-3

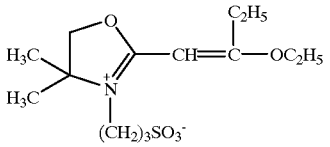

Synthesis of Intermediate II-1:

In a 100 ml three-necked flask, 4.6 g of 3-(2,4,4-trimethyloxazolinio)propanesulfonate, 7.9 g of N,N'-diphenylformamidine, 30 ml of acetonitrile and 2 ml of acetic anhydride were placed, and stirred for 1 hour on a steam bath. After cooling, the crystalline precipitate was filtered off, and washed with acetonitrile. Yield: 3.5 g.

Synthesis of Intermediate II-2:

In a 100 ml three-necked flask, 4.6 g of 3-(2-ethyl-4,4-dimethyloxazolinio)propanesulfonate, 9.9 g of N,N'-diphenylformamidine, 50 ml of acetonitrile and 0.5 ml of acetic anhydride were placed, and stirred for 1 hour on an oil bath kept at 120° C. After cooling, the solvent was distilled away under reduced pressure, and purified by the use of a column of Sephadex LH-20 to obtain the intended compound. Yield: 2.8 g.

Synthesis of Intermediate II-3:

In a 100 ml three-necked flask, 5.0 g of 3-(2,4,4-trimethyloxazolinio)propanesulfonate, 7.5 g of triethyl orthopropionate and 10 ml of m-cresol were placed, and stirred for 6 hour on a steam bath. After cooling, the crystalline precipitate was filtered off, and washed with ethyl acetate.

Yield: 5.5 g.

Synthesis of Exemplified Compound I-1:

In a 100 ml flask, 1.7 g of Intermediate II-1, 1.0 g of 4-oxo-3-phenyl-2-thioxooxazoline, 20 ml of ethanol and 0.5 ml of acetic anhydride were placed, and heated to 80° C. Thereto, 1 g of triethylamine was added to run the reaction for 50 minutes. After cooling, the solvent was distilled away under reduced pressure, and the residue was dissolved in 50 ml of ethanol. Thereto, 50 ml of a 2% ethanol solution of sodium acetate was added dropwise to separate a yellow crystalline precipitate. The precipitate was filtered off, and purified by recrystallization from methanol. Thus, 800 mg of the intended compound was obtained. $\lambda_{max}$: 436 nm.

Synthesis of Exemplified Compound I-2:

In a 100 ml flask, 2.1 g of Intermediate II-2, 1.5 g of 4-oxo-3-phenyl-2-thioxooxazoline, 50 ml of acetonitrile, 0.5 ml of acetic anhydride and 1 ml of triethylamine were placed, and underwent reaction for 1 hour on a steam bath. After cooling, the solvent was distilled away under reduced pressure, and the residue was dissolved in 50 ml of ethanol. Thereto, 50 ml of a 2% ethanol solution of sodium acetate was added dropwise to separate a yellow crystalline precipitate. The precipitate was filtered off, and purified by recrystallization from methanol. Thus, 450 mg of the intended compound was obtained. $\lambda_{max}$: 448 nm.

Synthesis of Exemplified Compound I-3:

In a 100 ml flask, 1.6 g of Intermediate II-3, 1.0 g of 4-oxo-3-phenyl-2-thioxooxazoline, 20 ml of pyridine and 0.5 ml of acetic anhydride were placed, and underwent reaction for 2 hour on a steam bath. After cooling, the solvent was distilled away under reduced pressure, and the residue was purified by the use of a column of Sephadex LH-20. The pyridinium salts obtained was dissolved in 50 ml of ethanol, and thereto 50 ml of a 2% ethanol solution of sodium acetate was added dropwise. Further thereto was added 100 ml of isopropyl alcohol to separate a yellow crystalline precipitate. The precipitate was filtered off, and purified by recrystallization from methanol. Thus, 450 mg of the intended compound was obtained. $\lambda_{max}$: 432 nm.

The compounds according to the present invention which are represented by formula (I), including those having formulae (II), (III) and (IV) respectively, are present stably upon storage, but they rapidly shift their absorption wavelengths to shorter wave lengths when absorb light of particular wavelengths; as a result, their original colors disappear. Therefore, these methine compounds according to the present invention which are represented by formula (I), including those having formulae (II), (III) and (IV) respectively, are useful for photographic spectral sensitizing dyes and dyes for photographic materials.

The compounds according to the present invention which are represented by formula (I), including those having formulae (II), (III) and (IV) respectively, can be present in any of constituent layers of a silver halide photographic material. In cases where these compounds are used as spectral sensitizing dyes, it is desirable that they be present in hydrophilic colloid layers comprising light-sensitive silver halide grains in a condition that they are absorbed to the light-sensitive silver halide grains.

Incorporation of the compounds according to the present invention which are represented by formula (I), including those having formulae (II), (III) and (IV) respectively, into silver halide emulsions may be carried out by directly dispersing them into the emulsions, or firstly dissolving them in appropriate solvents, such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and a mixture of two or more thereof, and then adding to the emulsions.

Also, the methine compounds according to the present invention can be incorporated into emulsions using various methods, e.g., the method as described in U.S. Pat. No. 3,469,987 wherein a dye is dissolved in a volatile organic solvent, the resulting solution is dispersed into water or a hydrophilic colloid, and then the dispersion liquid is added to an emulsion; the method as described in JP-B-46-24185 wherein a water-insoluble dye is dispersed into a water-soluble solvent without being dissolved therein, and then the dispersion liquid is added to an emulsion; the method as described in JP-B-44-23389, JP-B-44-27555 or JP-B-57-22091 wherein a dye is dissolved in an acid and then the resulting solution is added to an emulsion, or a dye is dissolved in water in the presence of an acid or base and then the resulting solution is added to an emulsion; the method as described in U.S. Pat. No. 3,822,135 or U.S. Pat. No. 4,006,026 wherein an aqueous solution or colloidal dispersion liquid of dye is prepared in the presence of a surfactant and then added to an emulsion; the method as described in JP-A-53-102733 or JP-A-58-105141 (The term "JP-A" as used herein means an "unexamined published Japanese patent application") wherein a dye is dispersed directly into a hydrophilic colloid and then the dispersion liquid is added to an emulsion; and the method as described in JP-A-51-74624 wherein a dye is dissolved with a red shift compound and then the resulting solution is added to an emulsion.

Supersonic waves can be used for dissolving a dye.

The time for the methine compounds according to the present invention to be added to silver halide emulsions according to the present invention may be in any stages of emulsion-making process as far as they have hitherto been admitted to be useful for addition of spectral sensitizing dyes or photographic dyes. For instance, the methine compounds according to the present invention can be added in the stage of forming silver halide grains or/and in a period before desalting, or in the desalting stage and/or the period after desalting and before the beginning of chemical ripening, as disclosed in U.S. Pat. No. 2,735,766, U.S. Pat. No. 3,628,960, U.S. Pat. No. 4,183,756, U.S. Pat. No. 4,225,666, JP-A-58-184142 and JP-A-60-196749; or they can be added just before or in the stage of chemical ripening, or in any stage or step during the period after the completion of chemical ripening and before the emulsion coating, as disclosed in JP-A-58-113920. Additionally, as disclosed in U.S. Pat. No. 4,225,666 and JP-A-58-7629, the same compound alone or in combination with a compound having a different structure may be added in different periods, for examples, in the grain formation stage and the chemical ripening stage or the period after the completion of chemical ripening, or before or in the stage of chemical ripening and in the period after the completion of chemical ripening, and in such separate additions different compounds or combinations with different compounds may be used respectively.

The compounds according to the present invention which is represented by formula (I), including those having formulae (II), (III) and (IV) respectively, are used in an amount of from 0.1 to 4 millimole, preferably from 0.2 to 2.5 millimole, per mole of silver halide. Further, they may be used in combination with other sensitizing dyes. The silver halide emulsions prepared in accordance with the present invention can be used in a color photographic material, and a black-and-white photographic material as well. Examples of a typical color photographic material to which the compounds according to the present invention are applicable include color paper, films for taking color photographs and color reversal films, and those of a black-and-white photographic material to which the compounds according to the present invention are applicable include X-ray sensitive films, films for taking black-and-white photographs and photographic films for photomechanical process.

The photographic materials to which the emulsions according to the present invention are applied have no particular limitations as to the other additives. For details of such additives the description in, e.g., *Research Disclosure*, volume 176, item 17643 (RD 17643) and ibid., volume 187, item 18716 (RD 18716) can be referred to.

The description places for additives in RD 17643 and RD 18716 are shown in Table 1.

TABLE 1

| Additives | RD 17643 | RD 18716 |
|---|---|---|
| 1. Chemical sensitizer | p. 23 | p. 648, right column |
| 2. Sensitivity increasing agent | | p. 648, right column |
| 3. Spectral sensitizer Supersensitizer | pp. 23–24 | p. 648, right column, to p. 649, right column |
| 4. Brightening agent | p. 24 | |
| 5. Antifoggant and Stabilizer | pp. 24–25 | p. 649, right column |
| 6. Light absorbent, Filter dye, and UV absorbent | pp. 25–26 | p. 649, right column, to p. 650, left column |
| 7. Stain inhibitor | p. 25, right column | p. 650, left to right column |
| 8. Dye image stabilizer | p. 25 | |
| 9. Hardener | p. 26 | p. 651, left column |
| 10. Binder | p.26 | p. 651, left column |
| 11. Plasticizer, Lubricant | p. 27 | p. 650, right column |
| 12. Coating aid Surfactant | pp. 26–27 | p. 650, right column |
| 13. Antistatic agent | p. 27 | p. 650, right column |

In the photographic materials of the present invention, colloidal silver and dyes can be used as filter dyes or other various purposes, such as the prevention of irradiation, the prevention of halation, in particular, the separation between spectral sensitivity distributions of light-sensitive layers, and the security for safelight immunity. Suitable examples of such dyes include oxonol dyes, hemioxonol dyes, styryl dyes, merocyanine dyes, anthraquinone dyes and azo dyes. Also, cyanine dyes, azomethine dyes, triarylmethane dyes and phthalocyanine dyes are useful. Further, oil-soluble dyes emulsified by an oil-in-water dispersion method can be added to a hydrophilic colloid layer.

As an antifoggant and a stabilizer which are included in the above-recited additives, azoles (e.g, benzothiazolium salts, nitroindazoles, nitrobenzimidazoles, chlorobenzimidazoles, bromobenzimidazoles, nitroindazoles, benzotriazoles, aminotriazoles), mercapto compounds (e.g., mercaptothiazoles, mercaptobenzothiazoles, mercaptobenzimidazoles, mercaptothiadiazoles, mercaptotetrazoles, mercaptopyrimidines, mercaptotriazines, preferably 1-phenyl-5-mercaptotetrazole), thioketo compounds (e.g., oxazolinethione), azaindenes (e.g., triazaindenes, tetraazaindenes, pentaazaindenes, preferably 4-hydroxy-substituted 1,3,3a,7-tetraazaindenes), benzenethiosulfonic acid, benzenesulfinic acid and benzenesulfonamide can be used to advantage.

Non-diffusible color couplers having hydrophobic groups called ballast groups or polymeric color couplers are preferably used in the present invention. These couplers each may be either a coupler equivalent to two silver ions or a coupler equivalent to four silver ions. Also, couplers having color compensating effects or couplers capable of releasing development inhibitors upon development (the so-called DIR couplers) may be used. Further, non-color-forming DIR coupling compounds capable of producing colorless compounds and releasing development inhibitors upon coupling reaction may be employed.

Suitable examples of those couplers include compounds as disclosed, e.g., in JP-A-62-215272, page 91, from right upper column, line 4, to page 121, left upper column, line 6, and in JP-A-2-33144, from page 3, right upper column, line 14, to page 18, left upper column, the end line, and from page 30, right upper column, line 6, to page 35, right lower column, line 11; compounds represented by formula (I), (II), (III) or (IV) as disclosed in EP-A-378236, page 11 (in particular, T-101 (page 30), T-104 (page 31), T-113 (page 36), T-131 (page 45), T-144 (page 51), and T-158 (page 58)); compounds represented by formula (I) as disclosed in EP-A-436938, page 7 (in particular, D-49 (page 51); and compounds represented by formula (1) as disclosed in JP-A-5-307248 (in particular, (23) in paragraph 0027).

Examples of a magenta coupler which can be used in the present invention include 5-pyrazolone couplers, pyrazolobenzimidazole couplers, pyrazolotriazole couplers, pyrazolotetrazole couplers, cyanoacetylcumarone couplers and open-chain acylacetonitrile couplers, yellow couplers which can be used are acylacetamide couplers (e.g., benzoylacetanilides, pivaloylacetanilides), and cyan couplers which can be used are naphthol couplers and phenol couplers. Of those cyan couplers, the phenol couplers wherein an ethyl group is present at the meta-position of the phenol nucleus, the 2,5-diacylamino-substituted phenol couplers, the phenol couplers wherein a phenylureido group is present at the 2-position and an acylamino group is present at the 5-position and the naphthol couplers wherein a sulfonamido, amido or like group is substituted on the 5-position thereof, as described in U.S. Pat. Nos. 3,772,002, 2,772,162, 3,758,308, 4,126,396, 4,334,011, 4,327,173, 3,446,622, 4,333,999, 4,451,559 and 4,427,767, are preferable because of their superiority in image fastness.

In order to satisfy characteristics required for the photographic materials of the present invention, those couplers as recited above can be incorporated in the same layer in combination of two or more thereof, or the same coupler may be incorporated in two or more of separate layers.

Examples of a typical discoloration inhibitor include hydroquinones, 6-hydroxychromans, 5-hydroxycoumarans, spirochroman, p-alkoxyphenols, hindered phenols centering around bisphenols, gallic acid derivatives, methylenedioxybenzenes, aminophenols, hindered amines, and the ether or ester derivatives obtained by silylating or alkylating the phenolic hydroxyl groups of the compounds recited above. Also, metal complexes represented by (bissalicylaldoximato)nickel complexes and (bis-N,N-dialkyldithiocarbamato)nickel complexes can be used as discoloration inhibitor.

The photographic processing of the photographic materials of the present invention can be performed using any of known methods and any of known processing solutions. The processing temperature is generally chosen from the range of 18° C. to 50° C., but it may be lower than 18° C. or higher than 50° C. Either development-processing for forming silver image (black-and-white photographic processing) or color photographic processing which involves the development-processing for forming dye images may be applied to the photographic materials of the present invention in answer to their purposes.

In a black-and-white developer, known developing agents, such as dihydroxybenzenes (e.g., hydroquinone), 3-pyrazolidones (e.g., 1-phenyl-3-pyrazolidone) and aminophenols (e.g., N-methyl-p-aminophenol) can be used alone or in combination of two or more thereof.

In general a color developer is an alkaline aqueous solution containing a color developing agent. As the color developing agent can be used known aromatic primary amines, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline,4-amino-3-methyl-N-ethyl-N-β-methoxyethylaniline).

In addition to these compounds, color developing agents which may be used herein include those described, e.g., in L. F. A. Mason, *Photographic Processing Chemistry*, pages 226–229, Focal Press (1966), U.S. Pat. No. 2,193,015, U.S. Pat. No. 2,592,364 and JP-A-48-64933.

Besides the developing agent, each developer can contain pH buffers, such as sulfites, carbonates, borates and phosphates of alkali metals, and development inhibitors or antifoggants, such as bromides, iodides and organic antifoggants. Further, each developer may contain water softeners, preservatives such as hydroxylamine, organic solvents such as benzyl alcohol and diethylene glycol, development accelerators such as polyethylene glycol, quaternary ammonium salts and amines, dye forming couplers, competing couplers, fogging agents such as sodium borohydride, auxiliary developing agents such as 1-phenyl-3-pyrazolidone, viscosity imparting agents, the polycarboxylic acid type chelating agents described in U.S. Pat. No. 4,083,723 and antioxidants described in West German Patent Publication (OLS) No. 2,622,950, if needed.

In the case of color photographic processing, the photographic materials are generally bleached after color development. The bleach processing may be carried out simultaneously with fixing or separately therefrom. Examples of a bleaching agent which can be used therein include polyvalent metal compounds such as iron(III), cobalt(III), chromium(IV) or copper(II) compounds, peracids, quinones, and nitroso compounds. Specifically, ferricyanides, bichromates, and iron(III) or cobalt(II) complexes of organic acids, such as aminopolycarboxylic acids (e.g., ethylenediaminetetraacetic acid, nitrilotriacetic acid, 1,3-diamino-2-propanoltetraacetic acid), citric acid, tartaric acid and malic acid; persulfates and permanganates; and nitrosophenols. Of these compounds, potassium ferricyanide, sodium ethylenediaminetetraacetato ferrate, ammonium ethylenediaminetetraacetato ferrate are particularly useful. Ethylenediaminetetraacetato ferrate complexes are useful in both an independent bleaching bath and a combined bleaching and fixing bath.

The bleaching or bleach-fix bath also can contain various additives, such as the bleach accelerators described, e.g., in U.S. Pat. Nos. 3,042,520 and 3,241,966, JP-B-45-8506 and JP-B-45-8836, and the thiol compounds described in JP-A-53-65732. After the bleach or bleach-fix processing, the photographic materials may be washed with water or processed with a stabilizing bath alone.

In the image formation processing for the silver halide photographic materials of the present invention, irradiation for shifting the absorption wavelengths of the compounds represented by formula (I) according to the present invention can be performed at any time, provided that the time for irradiation is in a period after development processing for forming silver image in the case where the photographic materials are black-and-white photographic materials, or in a period after color development processing for forming dye images in the case where the photographic materials are color photographic materials. More specifically, the irradiation can be carried out during, before or after the fixing step, the washing or stabilizing step or the drying step in the processing of black-and-white photographic materials; while in the processing of color photographic materials the irradiation can be carried out during, before or after the bleach or bleach-fix step, the washing or stabilizing step or the drying step. Also, the absorption wavelengths of the compounds represented by formula (I) according to the present invention which remain in the photographic material after photographic processing may be shifted by exposure to natural light without positive irradiation.

The light sources employed for irradiating the silver halide photographic materials of the present invention to shift the absorption wavelengths of the compounds of formula (I) incorporated therein may be any of generally used light sources. Specifically, a wide variety of known light sources, such as natural light (sun light), a tungsten lamp, a fluorescent lamp, a mercury lamp, a xenon arc lamp, a carbon arc lamp, a xenon flash lamp, laser beams and light-emitting diodes, can be employed for the foregoing purpose. The irradiation time may be in the range of $1/10^4$ to $1/10^6$ second when the flash irradiation is performed with a xenon flash lamp, or it may be in the range of $1/10^3$ to 1 second in the case of short irradiation, or it may be longer than 1 second. The spectral distribution of the light used for the irradiation can be controlled with a color filter, if needed. In irradiating a photographic material with light, the surface thereof may be irradiated all over at the same time, or it may undergo scanning irradiation with, e.g., laser beams. Such a light source may be installed in a processing bath used for image formation processing, or it may be mounted on the travelling path of photographic materials, or the irradiation may be performed after the completion of image formation processing.

The supports usable in the present invention include transparent films generally used for photographic materials, such as cellulose triacetate and polyethylene terephthalate films, and reflection type supports.

The term "reflection type support" as used herein refers to the support having high reflectivity to impart clearness to the dye images formed in silver halide emulsion layers. Such a reflection type support includes a support coated with a hydrophobic resin in which is dispersed a light reflecting material for heightening the reflectivity in the wavelength region of visible light, such as titanium oxide, zinc oxide, calcium carbonate or calcium sulfate, and a support made from a hydrophobic resin in which a light reflecting material is dispersed. As examples of a support usable in the present invention, mention may be made of baryta paper, polyethylene coated paper, synthetic paper of polypropylene type, a transparent support which is provided with a reflection layer or in which a reflective material is incorporated, such as a glass plate, a polyester film such as a polyethylene terephthalate, cellulose triacetate or cellulose nitrate film, a polyamide film, a polycarbonate film, a polystyrene film and a vinyl chloride resin film. From these supports, the support used in the present invention can be properly selected depending on the end use purpose.

The exposure for forming photographic images can be effected using conventional methods. Specifically, any of a wide variety of known light sources, such as natural light (sun light), a tungsten lamp, a fluorescent lamp, a mercury lamp, a xenon arc lamp, a carbon arc lamp, a xenon flash lamp, laser, LED and CRT, can be used for the exposure. Suitable exposure times which can be used include not only exposure times generally used in cameras ranging from 1/1000 to 1 second, but also exposure times shorter than 1/1000 second, for example, from $1/10^4$ to $1/10^6$ second as used for the xenon flash exposure. Exposure times longer than 1 second can also be used. Further, the spectral distribution of the light employed for the exposure can be controlled with a color filter, if needed. Also, laser beams can be used for the exposure. In addition, the exposure may be performed with the light emitted from a phosphor excited by electron beams, X-rays, γ-rays, α-rays or the like.

The forms taken in using the compounds according to the present invention will now be illustrated in more detail by reference to the following examples. However, the use forms of the compounds according to the present invention should not be construed as being limited to these examples.

EXAMPLE 1

A silver iodobromide emulsion was prepared by mixing 1 l of a 1N aqueous solution of silver nitrate and 1 l of an aqueous solution containing 0.98 mole of potassium bromide and 0.02 mole of potassium iodide in 1 l of an aqueous solution containing 2 weight % of deionized ossein gelatin, 1.5 weight % of ammonia and 0.04% of potassium bromide in accordance with a double jet method as the temperature was kept at 50° C. After undergoing washing and desalting treatments, the emulsion was subjected to gold sensitization and sulfur sensitization so as to acquire the optimum sensitivity. The thus obtained emulsion grains were tabular grains having an average diameter of 1 μm and an average thickness of 0.15 μm.

To 45 g portions of this emulsion, methanol solutions of the compounds according to the present invention shown in Table 2 were each added, and mixed at 40° C. with stirring.

To each of the resulting emulsions, 10 mg of 4-hydroxy-6-methyl-1,3,3a,7-tetrazaindene, 15 g of a 10% gel of deionized gelatin and 55 ml of water were further added, and coated on a polyethylene terephthalate film support under the following condition.

Specifically, the amount of each emulsion coated was adjusted so as to have a silver coverage of 2.5 g/m$^2$ and a gelatin coverage of 3.8 g/m$^2$. And simultaneously with the emulsion, as the upper layer of the emulsion coating, an aqueous solution comprising 0.22 g/l of sodium dodecylbenzenesulfonate, 0.50 g/l of sodium p-sulfostyrene homopolymer, 3.1 g/l of sodium 2,4-dichloro-6-hydroxy-1,3,5-triazine and 50 g/l of gelatin was coated so as to have a gelating coverage of 1.0 g/m$^2$.

These sample films each underwent wedge exposure for $10^{-2}$ second under the illuminance of 3,200 lux by means of a xenon lamp having a color temperature of 2854° K.

After the exposure, the sample films were processed with an automatic developing machine, CEPROS-M, produced by Fuji Photo Film, Co., Ltd. for 30 seconds.

In order to measure residual color, samples were prepared by processing the same sample films as prepared above with the foregoing automatic developing machine without subjecting them to exposure. Each of the thus processed samples was divided into two film pieces. One film piece was exposed to light of 100,000 lux for 10 seconds by means of a xenon lamp, and the other film piece was stored in the dark. The density measurement of these films was made using a densitometer produced by Fuji Photo Film Co., Ltd., thereby determining the sensitivity to white light and the fog density. The standard point of the optical density to determine the sensitivity was fog+0.3. Additionally, the sensitivities are shown as relative values, with Sample 1-1 being taken as 100. The absorptivities of residual sensitizing dyes in those samples at the wavelengths of their respective absorption maxima were measured according to a reflection measurement method by means of a color analyzer, Model 607, made by Hitachi, Ltd.

The compounds used for comparison with the compounds according to the present invention are as follows:

Comparative Compound C-1

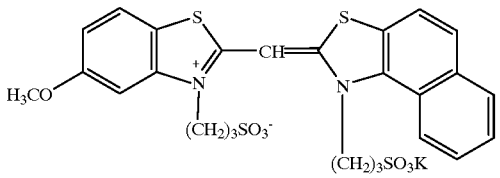

Comparative Compound C-2

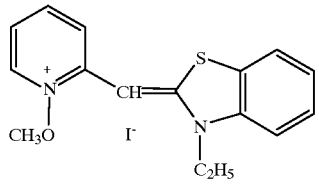

Comparative Compound C-3

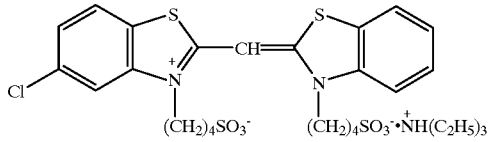

The results obtained are shown as relative values in Table 2.

TABLE 2

| Sample No. | Amount added $\times 10^4$ mol/ molAgX | | Sensitivity (Exposure time) $10^{-2}$ sec | $10^{-6}$ sec | Fog | Residual Color irradiated | unirradiated | Remarks |
|---|---|---|---|---|---|---|---|---|
| 1-1 | C-1 | 2.0 | 100* | 100* | 0.14 | 0.126 | 0.126 | comparison |
| 1-2 | C-2 | 2.0 | 98 | 87 | 0.13 | 0.085 | 0.092 | comparison |
| 1-3 | I-2 | 2.0 | 138 | 119 | 0.12 | 0.041 | 0.067 | invention |
| 1-4 | I-4 | 2.0 | 118 | 112 | 0.12 | 0.033 | 0.040 | invention |
| 1-5 | I-7 | 2.0 | 127 | 114 | 0.11 | 0.031 | 0.061 | invention |
| 1-6 | I-13 | 2.0 | 114 | 106 | 0.12 | 0.041 | 0.051 | invention |
| 1-7 | I-14 | 2.0 | 101 | 100 | 0.11 | 0.035 | 0.063 | invention |
| 1-8 | I-16 | 2.0 | 106 | 101 | 0.11 | 0.032 | 0.043 | invention |
| 1-9 | I-21 | 2.0 | 130 | 124 | 0.11 | 0.030 | 0.038 | invention |

*Standard

As can be seen from the results shown in Table 2, the sensitizing dyes represented by formula (I) have excellent sensitivities, and the irradiated samples comprising those sensitizing dyes were reduced in residual color, compared with the samples stored in the dark. (It is desirable that the residual color be not more than 0.09, expressed in terms of the value in the table. If the value goes up to over 0.09, residual color can be perceived by careful observation to render the photographic films unmarketable. When the values are greater than 0.1, the residual color is judged considerable.) Taking as an instance the photographic film using Exemplified Compound I-2 (Sample No. 1-3), it is said that the film not only had high sensitivity and low level of residual color but also was greatly reduced in residual color by irradiation with light, compared with Sample No. 1-2 using Comparative Compound C-2. Further, the data set forth in Table 2 indicate that the samples using the compounds according to the present invention had relatively low fog. Thus, it is concluded that the samples using the compounds according to the present invention have higher sensitivities than those using comparative compounds and the residual color therein is greatly bettered by irradiation with light.

EXAMPLE 2

0.4 l of a 1N aqueous solution of silver nitrate and 0.4 l of an aqueous solution containing a mixture of potassium bromide with potassium chloride, $1.5\times10^{-7}$ mole/mole Ag of potassium pentachloroaquarhodate(III) and $2\times10^{-7}$ mole/mole Ag of potassium hexachloroiridate(III) were admixed in 1 l of an aqueous gelatin solution containing 1,3-dimethyl-2-imidazolidinethione in accordance with a double jet method to prepare a silver chlorobromide emulsion having an average grain size of 0.22 gm and a silver chloride content of 70 mole %. The emulsion obtained was mixed with $1\times10^{-3}$ mole/mole Ag of potassium iodide to undergo conversion and then washed with water according to a flocculation method. Thereto, a methanol solution of each of the compounds according to the present invention set forth in Table 3 was added.

Further thereto, 300 ml of an aqueous solution containing 17 weight % of gelatin was added, and adjusted to pH 5.9 and pAg 7.3. Then, each of the resulting emulsions was chemically sensitized by being admixed with sodium benzenesulfonate, benzenesulfinic acid, sodium thiosulfate pentahydrate and chloroauric acid, and heated at 60° C. for 45 minutes. Further thereto were added 150 mg of 4-hydroxy-6-methyltetrazaindene as a stabilizer and 100 mg of Proxel as preservatives.

Each of the thus prepared silver halide emulsions was coated on a polyethylene terephthalate film support, which had undergone an antistatic treatment, in the same manner as in Example 1. The photographic film samples thus obtained were each exposed to light under the same condition as in Example 1, and then processed for 30 seconds at 30° C. with an automatic developing machine, FG-680A, produced by Fuji Photo Film Co., Ltd., wherein GD-D1 and GR-F1 (trade names, products of Fuji Photo Film Co., Ltd.) were used as developer and fixer respectively. In order to measure residual color, the unexposed samples were processed in the same manner as described above. Each of the thus processed samples was divided into two film pieces. One film piece was irradiated with 254 nm UV light for 15 seconds by means of a UV lamp, Model VL-4LC, made by Vilber Lourmat Co., Ltd., placed at the distance of 5 cm, and the other film piece was stored in the dark. The measurements of the sensitivity and the residual color were made in the same ways as in Example 1. The results obtained are shown in Table 3.

TABLE 3

| Sample No. | Amount added $\times 10^4$ mol/ molAgX | | Sensitivity (Exposure time) $10^{-2}$ sec | $10^{-6}$ sec | Fog | Residual Color irradiated | unirradiated | Remarks |
|---|---|---|---|---|---|---|---|---|
| 2-1 | C-1 | 2.0 | 100* | 100* | 0.12 | 0.086 | 0.086 | comparison |
| 2-2 | C-3 | 2.0 | 108 | 101 | 0.22 | 0.132 | 0.132 | comparison |
| 2-3 | I-1 | 2.0 | 177 | 158 | 0.12 | 0.033 | 0.048 | invention |
| 2-4 | I-3 | 2.0 | 148 | 124 | 0.12 | 0.041 | 0.080 | invention |
| 2-5 | I-6 | 2.0 | 127 | 106 | 0.11 | 0.030 | 0.043 | invention |
| 2-6 | I-15 | 2.0 | 119 | 108 | 0.11 | 0.031 | 0.061 | invention |
| 2-7 | I-16 | 2.0 | 139 | 112 | 0.12 | 0.038 | 0.048 | invention |
| 2-8 | I-20 | 2.0 | 118 | 106 | 0.11 | 0.042 | 0.063 | invention |

*Standard

As can be seen from the results shown in Table 3, the compounds according to the present invention conferred high sensitivities on the silver chliorobromide emulsion also and the residual color attributed to them was considerably reduced by irradiation with light.

EXAMPLE 3

Two samples (Sample Nos. 3-1 and 3-2) were prepared: specifically, Sample No. 3-1 was the same multilayer color photographic material as Sample 13 prepared in Example 4 of JP-B-5-18412 and Sample No. 3-2 was the sample prepared in the same manner as the foregoing photographic material, except that Compound I-1 used as the sensitizing dye was replaced by Exemplified Compound I-14 according to the present invention. These samples were each stored for 2 days at room temperature, and subjected to the same exposure and development-processing as described in the reference cited above, thereby determining their sensitivities to red light. On the other hand, each of these samples was development-processed without undergoing exposure, and divided into two pieces. One piece was subjected to wedge exposure for $10^{-2}$ second under the illuminance of 3,200 lux by means of a xenon lamp having a color temperature of 2854° K. And this wedge exposure was performed 5 time. The other piece was stored in the dark. The measurements of the sensitivity and the residual color were made in the same ways as in Example 1. The results obtained are shown in Table 4.

TABLE 4

| Sample No. | Sensitivity | Fog | Residual Color irradiated | unirradiated | Remarks |
|---|---|---|---|---|---|
| 3-1 | 100* | 0.12 | 0.89 | 0.89 | comparison |
| 3-2 | 106 | 0.11 | 0.40 | 0.56 | invention |

*standard

As can be seen from Table 4, the compound according to the present invention was superior in sensitivity and residual color even when it was used as spectral sensitizing dye in a multilayer color photographic material.

Silver halide photographic materials according to the present invention and the image formation method using them ensure high sensitivity and low level of residual color.

While the invention has been described in detail and with reference to specific examples thereof, it will be apparent to one skilled in the art that various changes and modifications can be made therein without departing from the spirit and scope thereof.

What is claimed is:

1. A method of forming images in a silver halide photographic material having on a support at least one silver halide emulsion layer, which comprises shifting the absorption wavelengths of the photographic material by irradiating the photographic material with light in the process of image formation after development-processing.

2. The method of forming images according to claim 1, wherein the photographic material comprises at least one compound represented by the following formula (I):

(I)

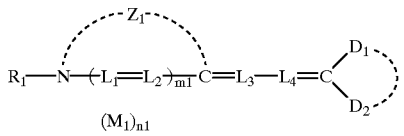

wherein $Z_1$ represents atomic groups forming a 5- or 6-membered nitrogen-containing heterocyclic ring, $D_1$ and $D_2$ are atomic groups forming an acyclic or cyclic acid nucleus, $R_1$ represents an alkyl group, $L_1$, $L_2$, $L_3$ and $L_4$ are each a methine group, $m_1$ is 0 or 1, $M_1$ represents a counter ion, and $n_1$ represents the number of counter ions required for neutralization of charges on one molecule.

3. The method of forming images according to claim 2, wherein the compound represented by formula (I) is a compound selected from the compounds having the following formula (II):

(II)

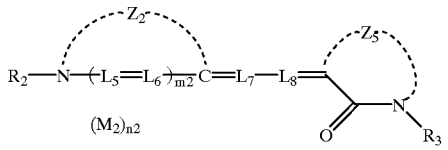

wherein $Z_2$ and $Z_5$ each represents atomic groups forming a 5- or 6-membered nitrogen-containing heterocyclic ring, $R_2$ represents an alkyl group, $R_3$ represents a hydrogen atom, an alkyl group, an aryl group or a heterocyclic group, $L_5$, $L_6$, $L_7$ and $L_8$ are each a methine group, $m_2$ is 0 or 1, $M_2$ represents a counter ion, and $n_2$ represents the number of counter ions required for neutralization of charges on one molecule.

4. The method of forming images according to claim 2, wherein the compound represented by formula (I) is a compound selected from the compounds having the following formula (III) or (IV):

(III)

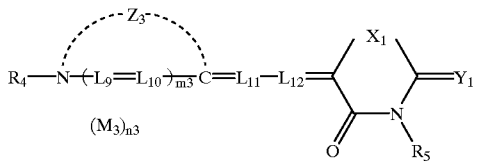

wherein $Z_3$ represents atomic groups forming a 5- or 6-membered nitrogen-containing heterocyclic ring, $R_4$ represents an alkyl group, $R_5$ represents a hydrogen atom, an alkyl group, an aryl group or a heterocyclic group, $L_9$, $L_{10}$, $L_{11}$, and $L_{12}$ are each a methine group, $X_1$ represents an oxygen atom, a sulfur atom or a group of formula —N($R_{10}$)—, $R_{10}$ represents a hydrogen atom, an alkyl group, an aryl group or a heterocyclic group, $Y_1$ represents an oxygen atom or a sulfur atom, $m_3$ is 0 or 1, $M_3$ represents a counter ion, and $n_3$ represents the number of counter ions required for neutralization of charges on one molecule;

(IV)

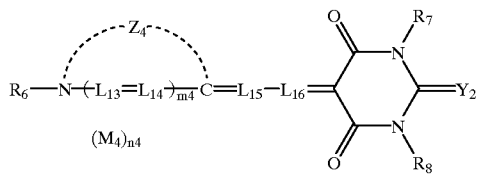

wherein $Z_4$ represents atomic groups forming a 5- or 6-membered nitrogen-containing heterocyclic ring, $R_6$ represents an alkyl group, $R_7$ and $R_8$ each represents a hydrogen atom, an alkyl group, an aryl group or a heterocyclic group, $L_{13}$, $L_{14}$, $L_{15}$ and $L_{16}$ are each a methine group, $Y_2$ represents an oxygen atom or a sulfur atom, $m_4$ is 0 or 1, $M_4$ represents a counter ion, and $n_4$ represents the number of counter ions required for neutralization of charges on one molecule.

* * * * *